US011009025B2

(12) United States Patent
Kameya et al.

(10) Patent No.: US 11,009,025 B2
(45) Date of Patent: May 18, 2021

(54) OIL-COOLED SCREW COMPRESSOR

(71) Applicant: Hitachi Industrial Equipment Systems Co., Ltd., Tokyo (JP)

(72) Inventors: Hirotaka Kameya, Ishinomaki (JP); Hideharu Tanaka, Tokyo (JP); Masahiko Takano, Tokyo (JP); Takeshi Tsuchiya, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 262 days.

(21) Appl. No.: 16/094,136

(22) PCT Filed: Mar. 30, 2017

(86) PCT No.: PCT/JP2017/013297
§ 371 (c)(1),
(2) Date: Oct. 16, 2018

(87) PCT Pub. No.: WO2017/183412
PCT Pub. Date: Oct. 26, 2017

(65) Prior Publication Data

US 2019/0128264 A1 May 2, 2019

(30) Foreign Application Priority Data

Apr. 19, 2016 (JP) ..... JP2016-083707

(51) Int. Cl.
*F03C 2/00* (2006.01)
*F03C 4/00* (2006.01)
(Continued)

(52) U.S. Cl.
CPC ..... *F04C 29/04* (2013.01); *F04C 18/084* (2013.01); *F04C 18/16* (2013.01); *F04C 18/20* (2013.01);
(Continued)

(58) Field of Classification Search
CPC ..... F04C 18/084; F04C 18/16; F04C 18/20; F04C 29/0007; F04C 29/04; F04C 29/042; F04C 2250/102; F04C 2250/20
See application file for complete search history.

(56) References Cited

U.S. PATENT DOCUMENTS 3,423,017 A * 1/1969 Lauritz ..... F04C 18/084 418/201.3
4,406,602 A * 9/1983 Kasuya ..... F04C 18/084 418/201.3
(Continued)

FOREIGN PATENT DOCUMENTS

JP 49-105748 U 9/1974
JP 01257785 A * 10/1989 ..... F04C 18/084
(Continued)

OTHER PUBLICATIONS

International Search Report (PCT/ISA/210) issued in PCT Application No. PCT/JP2017/013297 dated Jul. 4, 2017 with English translation (10 pages).
(Continued)

*Primary Examiner* — Theresa Trieu
(74) *Attorney, Agent, or Firm* — Crowell & Moring LLP

(57) ABSTRACT

In an oil-cooled screw compressor, a tooth crest arc of a fixed width is provided to the tooth crest of a male tooth profile, and simultaneously a tooth bottom arc is provided to the tooth bottom of a female tooth profile. Due to the actions thereof, the operation chamber immediately before disappearing exists only in a bottom half region from a line that connects the centers of the male and female tooth profiles, and the opening area relative to the volume of the operation chamber can be increased. As a result, the discharge of oil becomes smooth and energy loss is reduced.

14 Claims, 4 Drawing Sheets

(51) Int. Cl.

| | |
|---|---|
| ***F04C 18/00*** | (2006.01) |
| ***F04C 2/00*** | (2006.01) |
| ***F04C 29/04*** | (2006.01) |
| ***F04C 18/20*** | (2006.01) |
| ***F04C 18/08*** | (2006.01) |
| ***F04C 29/00*** | (2006.01) |
| ***F04C 18/16*** | (2006.01) |

(52) U.S. Cl.
CPC .... *F04C 29/0007* (2013.01); *F04C 2250/102* (2013.01)

(56) References Cited

U.S. PATENT DOCUMENTS 4,497,185 A * 2/1985 Shaw ..... F04C 29/007 418/99
4,780,061 A * 10/1988 Butterworth ..... F04C 29/04 418/85
5,044,906 A 9/1991 Tsuboi
2005/0244294 A1 11/2005 Murakami et al.

FOREIGN PATENT DOCUMENTS

| | | | |
|---|---|---|---|
| JP | 2-252991 | A | 10/1990 |
| JP | 2005-315149 | A | 11/2005 |
| JP | 2007-146659 | A | 6/2007 |
| JP | 2008-133763 | A | 6/2008 |
| JP | 2009-243325 | A | 10/2009 |

OTHER PUBLICATIONS

Japanese-language Written Opinion (PCT/ISA/237) issued in PCT Application No. PCT/JP2017/013297 dated Jul. 4, 2017 (eight (8) pages).

* cited by examiner

OIL-COOLED SCREW COMPRESSOR

TECHNICAL FIELD

The present invention relates to a screw compressor which compresses a gas such as air or a refrigerant gas, and more particularly, to a tooth profile suitable for enhancing an efficiency to achieve high performance by smoothly discharging the oil and rotating a rotor to reduce torque, in an oil-cooled screw compressor of a type in which oil is injected into an operation chamber in which a gas to be compressed is confined in a compression procedure.

BACKGROUND ART

Screw compressors are widely used as air compressors as air pressure sources and as refrigerant gas compressors for relatively large refrigeration air conditioning cycles. A geometric shape of a screw rotor, which can be said to be a heart of the screw compressors, has a great influence on performance, vibration noise, and reliability. In particular, a tooth profile defined as a contour shape in a cross section perpendicular to an axis of the rotor is an important characteristic for determining factors, various studies have been made for many years, and various tooth profiles have been proposed, verified and carried out.

For example, JP 2009-243325 A (Patent Document 1) discloses a tooth profile in which a vibration noise is small and a high performance can be achieved, using an involute curve or a circular arc having a center on a pitch circle at a specific position of the tooth profile. In addition, JP 2007-146659 A (Patent Document 2) discloses a method of providing an outer circumferential circular arc at a tooth tip of a male rotor to reduce leakage from a part between a male tooth tip and a bore surface of the casing.

CITATION LIST

Patent Document

Patent Document 1: JP 2009-243325 A
Patent Document 2: JP 2007-146659 A

SUMMARY OF THE INVENTION

Problems to be Solved by the Invention

Patent Document 1 aims to reduce internal leakage and maintain low noise. In addition, Patent Document 2 aims to increase a sealing effect of oil.

In contrast, concerning the high performance in the sense of improving energy efficiency in an oil-cooled screw compressor, it was found that the discharge resistance of oil is related as one of the factors of performance degradation. A relation between the tooth profile and the discharge resistance of oil is not disclosed in Patent Documents 1 and 2.

In the oil-cooled screw compressor, oil is injected into the operation chamber in the compression procedure of a gas to be compressed. The oil has three functions. A first function is a lubricant that helps the rotation transmission due to contact between the female and male rotors, a second function is a sealant that reduces the internal leakage of the gas to be compressed for filling the gap between the rotors, and a third function is a coolant for the gas to be compressed which increases in temperature by compression. There is an oil that is used because of a high useful aspect, but density and viscosity are several hundred to several thousand times as much as the gas to be compressed. Therefore, when passing through a small cross-sectional area, resistance of a completely different order of magnitude compared to the gas to be compressed is generated. Here, the flow path having the smallest cross-sectional area through which the oil passes is an opening portion of the discharge port just before the operation chamber disappears.

There is another important phenomenon. The operating principle of the screw compressor is to move the operation chamber in an axial direction by rotating both rotors. Although the gas to be compressed and oil are mixed in the operation chamber, oils that are not uniformly distributed and have a high density are likely to accumulate at corner of the rear side. Therefore, when the compression is completed and the discharge port opens, the gas to be compressed on the front side is discharged first, whereas the oil tends to remain to the last.

Just before the operation chamber disappears, since most of the fluid left in the operation chamber becomes oil and the opening area of the discharge port decreases, the discharge resistance significantly increases. Although the discharge resistance is large, since the volume of the operation chamber decreases, the internal pressure of the operation chamber rises. This high pressure acts on the tooth surface of the rotor, which causes an increase in the torque for driving the rotor.

Since this phenomenon occurs every time at the period of the meshing of the rotors at the timing just before the operation chamber disappears, an increase in the drive torque of the screw compressor is caused, and in the case of electric motor, the power consumption of the motor is increased. That is, the discharge resistance of the oil causes extra energy consumption, which is one cause of performance degradation.

In view of the above circumstances, an object of the oil-cooled screw compressor of the present invention is to reduce the driving resistance of the rotor by reducing the discharge resistance of oil and to improve the energy efficiency, that is, the performance.

Solutions to Problems

In order to solve the above-mentioned problems, the present invention provides, for example, an oil-cooled screw compressor including: a screw rotor which has a pair of a male rotor and a female rotor rotating by meshing with each other around two parallel axes and each having twisted teeth, and in which most of teeth of the male rotor are located outside a male pitch circle centered on the axis of the male rotor in a cross section perpendicular to the axis of the male rotor, and most of teeth of the female rotor are located inside a female pitch circle centered on the axis of the female rotor in the cross section perpendicular to the axis of the female rotor; and a casing which has a bore including two cylindrical holes which partly overlap and have the same length to accommodate the pair of the male rotor and the female rotor, and in which an end surface of the bore is a bore end surface that faces in parallel with end surfaces of the pair of the male rotor and the female rotor at a slight gap, the casing being provided with an oil injection port in at least one of operation chambers formed by being surrounded with tooth grooves of the pair of the male rotor and the female rotor meshing with each other and the bore accommodating the tooth grooves, and the bore end surface being provided with an opening portion serving as a discharge port which discharges oil injected together with a gas to be compressed, in which a tooth profile curve representing a contour shape of the screw rotor on a cross section perpendicular to the axis of the screw rotor has only a finite length of a section having a maximum radius in the male rotor, the section is a circular arc, a center of the circular arc coincides with the center of the male rotor tooth profile, the tooth profile curve has only a finite length of a section having a minimum radius in the female rotor, the section is a circular arc, a center of the circular arc coincides with the center of the female rotor tooth profile, a ratio of an opening angle of the circular arc which is the finite section of the male rotor to an opening angle of the circular arc which is the finite section of the female rotor is equal to a ratio of the number of teeth of the female rotor to the number of teeth of the male rotor, a contour shape on a discharge side bore end surface of the discharge port sets a position at which a tooth tip of the male rotor passes on a line segment connecting respective rotation centers which are the axes of the pair of the male rotor and the female rotor, as a base point, a contour line extending from the base point to the male rotor side is located on a locus line when the tooth tip of the male rotor facing the base point is reversely rotated or to be closer to the center of the male rotor tooth profile than the locus line, and the contour line extending from the base point to the female rotor side is located on the locus line when the tooth base of the female rotor is reversely rotated or to be closer to the center of the female rotor tooth profile than the locus line.

Effects of the Invention

According to the present invention, it is possible to provide an oil-cooled screw compressor that reduces the torque for driving the rotor by reducing discharge resistance of oil and improves energy efficiency.

MODE FOR CARRYING OUT THE INVENTION

Figure 1:
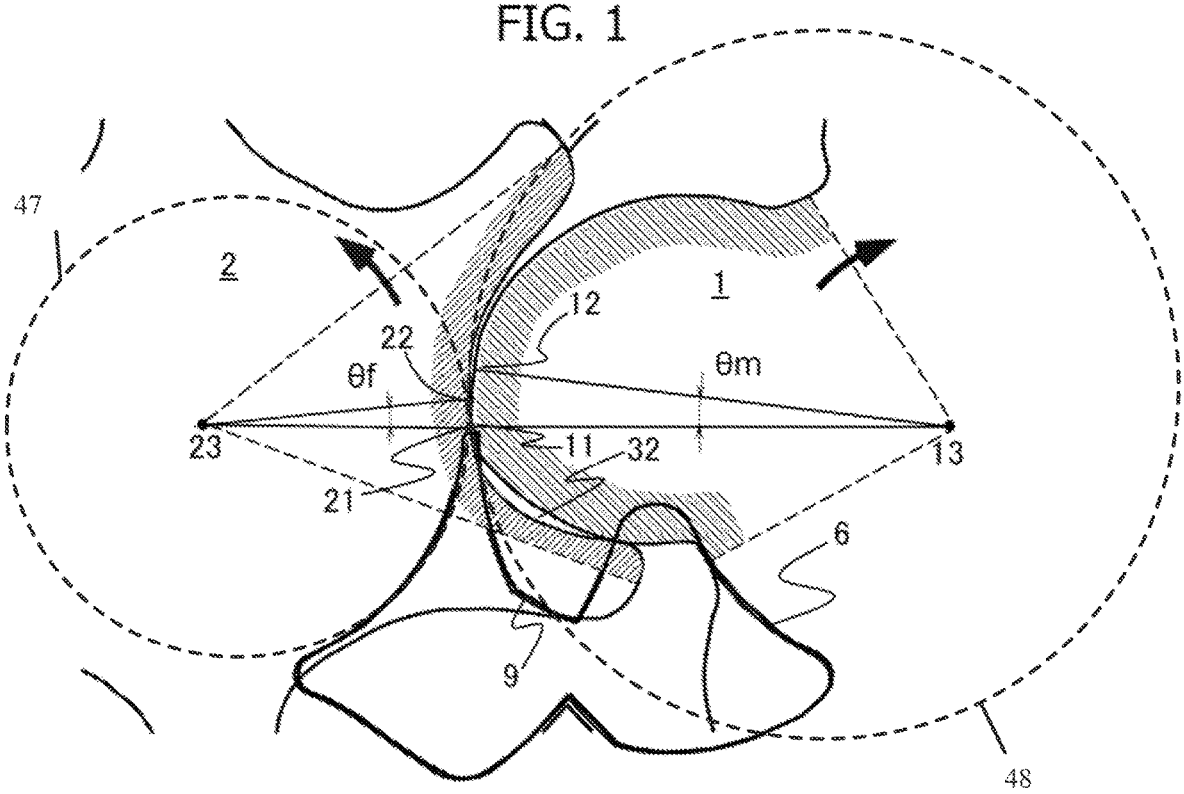
FIG. 1 is a contour line view of a tooth profile of a rotor and a discharge port of an oil-cooled screw compressor according to this embodiment.
Figure 2:
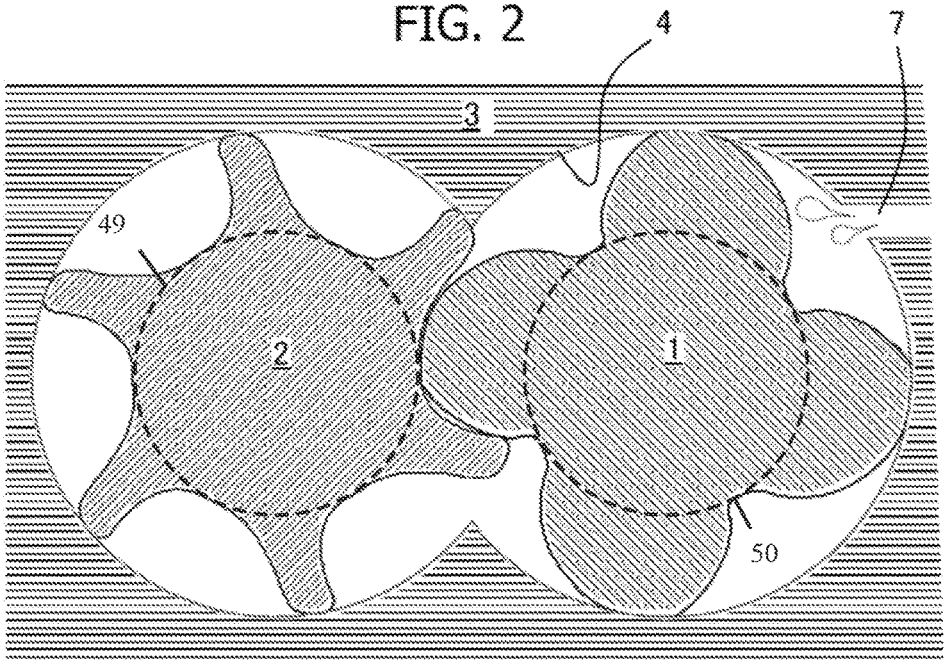
FIG. 2 is a cross-sectional view perpendicular to an axis of a rotor of the oil-cooled screw compressor according to this embodiment.

An embodiment of the present invention will be described with reference to FIGS. 1 to 6. FIG. 1 is an enlarged view of a tooth profile of female and male rotors, and FIG. 2 is a cross-sectional view of a compressor. As can be seen from FIG. 2, in this embodiment, the number of teeth Zm of the male rotor 1 is set as 4, and the number of teeth Zf of the female rotor 2 is set as 6.

The oil-cooled screw compressor includes a screw rotor which has a pair of a male rotor 1 and a female rotor 2 rotating by meshing with each other around parallel two axes and each having twisted teeth, and in which most of teeth of the male rotor 1 are located outside a male pitch 50 circle centered on the axis of the male rotor 1 in a cross section perpendicular to the axis of the male rotor 1, and most of teeth of the female rotor 2 are located outside the female pitch circle 49 centered on the axis of the female rotor 2 in the cross section perpendicular to the axis of the female rotor 2; and a casing 3 which has a bore 4 including two cylindrical holes which partly overlap and have the same length to accommodate the pair of rotors, and in which an end surface of the bore 4 is a bore end surface that faces in parallel with end surfaces of the pair of rotors at a slight gap, and the casing 3 is provided with an oil injection port 7 in at least one of operation chambers formed by being surrounded with tooth grooves of a pair of rotors meshing with each other and the bore 4 accommodating the tooth grooves, and the bore end surface is provided with a discharge port which discharges the oil injected together with a gas to be compressed. Here, in the male pitch circle 50 and the female pitch circle 49, a point obtained by dividing a line segment connecting the rotation center of the male rotor and the rotation center of the female rotor by a ratio of the number of teeth of the male rotor and the number of teeth of the female rotor is called a pitch point P, a circle in which a distance from the rotation center of the male rotor to the pitch point P is a radius is called a male pitch circle 50, and a circle in which a distance from the rotation center of the female rotor to the pitch point P is a radius is called a female pitch circle 49.

The male rotor 1 and the female rotor 2 rotate, while meshing with each other in the respective cylindrical holes. A tooth profile is geometrically designed for the meshing part between the male rotor 1 and the female rotor 2 to theoretically have a gap of 0, an appropriate gap is set in the tooth profile to allow thermal deformation, gas pressure deformation, vibration and machining error, and the meshing part is manufactured to be thinner by that amount. Since the essence of the present invention does not directly participate in the setting method of the gap, although the existence of the gap is added to the consideration, the tooth profile described in this embodiment is geometrically designed and described a gap as 0. Therefore, even if expressed as "contact" in the sentence, there are many cases where a minute gap exists between the actual tooth profiles.

Regarding the direction in which the screw compressor is installed, unlike the direction illustrated in FIG. 2, it is also possible to consider a method of vertically arranging both rotors (the male rotor 1 and the female rotor 2) so that the rotary shaft is in the vertical direction, vertically arranging the female and male axes are, or changing female and male axes to be upside down. However, in this embodiment, as will be described in a comparatively large number of cases, a case where female and male rotors are installed as illustrated in FIG. 1 and FIG. 2 will be described. Also, the twist direction of the rotor can be opposite. Therefore, the upward and downward directions and the rotational direction of the rotors used in this embodiment are in conformity with the arrangement of this embodiment and are not universal.

FIG. 1 illustrates this range with hatched by paying attention to one tooth portion of the tooth profile of the male rotor 1 and the tooth profile of the female rotor 2. The male rotor 1 rotates clockwise and the female rotor 2 rotates counterclockwise. In FIG. 1, a rear tooth tip point 11 of the male rotor 1 is in contact with a rear tooth base point 21 of the female rotor 2, and the rotation angle of both rotors at this time is set to the reference, that is, the rotation angle of 0 degree. In the tooth profile curve of the male rotor 1, the rear tooth tip point 11 has the maximum radius of rotation and reaches a front tooth tip point 12 with the same maximum radius. Therefore, a section between the rear tooth tip point 11 and the front tooth tip point 12 is a circular arc called a tooth tip circle 48, and its center coincides with the rotation center 13 of the male rotor. In this embodiment, an opening angle of the tooth tip circular arc is set to θm=6 degrees. Similarly, in the tooth profile curve of the female rotor 2, the rear tooth base point 21 has the minimum radius of rotation and reaches the front tooth base point 22 with the same minimum radius. Therefore, a section between the rear tooth base point 21 and the front tooth base point 22 is a circular arc called a tooth base circle 47, and its center coincides with the rotation center 23 of the female rotor. The opening angle of the tooth base circular arc is set to θf=4 degrees.

When the opening angle and the number of teeth of these female and male rotors satisfy the following formula (1), continuous meshing of the female and male rotor is established.

$$\theta m:\theta f=Zf:Zm \quad (1)$$

Since the curve on the rear side (front and rear of the tooth profile means front and rear with respect to the rotational direction) of the rear tooth tip point 11 of the male rotor 1 is not essence of the present invention, a retreating surface of the tooth profile of the Patent Document 1 is used. As the curve on the front side of the front tooth tip point 12, the advancing surface of Patent Document 1 is used. However, when the tooth profile of the male rotor 1 is reversely rotated by 6 degrees from the reference and the rotation angle is set to minus 6 degrees and the front tooth tip point 12 is on a line segment connecting the rotation centers 23 and 13 of the female and male rotors, a shape connecting the curves of the advancing surface of Patent Document 1 to the front side from the point 12 is obtained. Thus, a smooth continuous tooth profile can be formed at the front tooth tip point 12.

The tooth profile curve of the retreating surface of the female rotor of Patent Document 1 is used as a curve after the rear tooth base point 21 of the female rotor 2, and the tooth profile curve of the advancing surface of the female rotor of Patent Document 1 is used as the curve on the front side of the front tooth base point 22. As for the front side, like the male rotor 1, when the female rotor is reversely rotated by 4 degrees from the reference and the front tooth base point 22 is set to a position aligned with the line connecting the rotation centers 23 and 13 of the female and male rotors, a shape which connects the curve of the advancing surface of Patent Document 1 to the front side from the front tooth base point 22 is obtained.

In tooth profile of the conventional female rotor, except for the tooth profile of Patent Document 2, the portions near the tooth tip at both ends of the tooth are convex curves, and the vicinity of the center between them is a concave curve. In contrast, as a feature of the tooth profile of the female rotor 2 according to this embodiment, since the section 21 to 22 of the tooth base circle in the vicinity of the center of the tooth profile are convex, both sides thereof are concave, and both end portions which are outside thereof are convex.

A contour shape of the discharge port 6 is adapted to the tooth profile. The inside of the contour line is an opening portion which opens to the discharge side bore end surface as the discharge port. The drawing is divided, by the line segment connecting the rotation center 13 of the male rotor and the rotation center 23 of the female rotor, into an upper half region and a lower half region which are opposite to the rotation direction, but the discharge port 6 opens to the lower half region. When both rotors are at the reference position of 0 degree, the rear tooth tip point 11 of the male rotor and the rear tooth base point 21 of the female rotor are in contact with each other, but the position facing the contact point is set as a base point of the contour line of the discharge port 6. Further, the term "facing" means that it is at a position in which the rear tooth tip point and the rear tooth base point are in close contact with each other with the gap between the rotor end surface and the bore end surface being sandwiched therebetween, and in FIG. 1 and FIG. 2, the rear tooth tip point 11, the rear tooth base point 21 and the base point appear to overlap each other on the same point.

The contour line extending from the base point to the right side matches the locus traced by the rear tooth tip point 11 when the male rotor 1 is reversely rotated from the reference position. Alternatively, it is a line slightly shifted from the locus thereof, for example, within 3% of the radius of the male rotor to a line shifted toward the rotation center 13 of the male rotor. Similarly, the left side from the base point is set to a locus traced by the rear tooth base point 21 when the female rotor 2 is reversely rotated from the reference position, or to be closer to the rotation center 23 of the female rotor slightly smaller than the locus line, for example, within 3% of the female rotor radius. Therefore, the right and left lines are close to each other just below the base point, and the width thereof is about the width of the tool such as the end mill for processing the discharge port 6.

Figure 3:
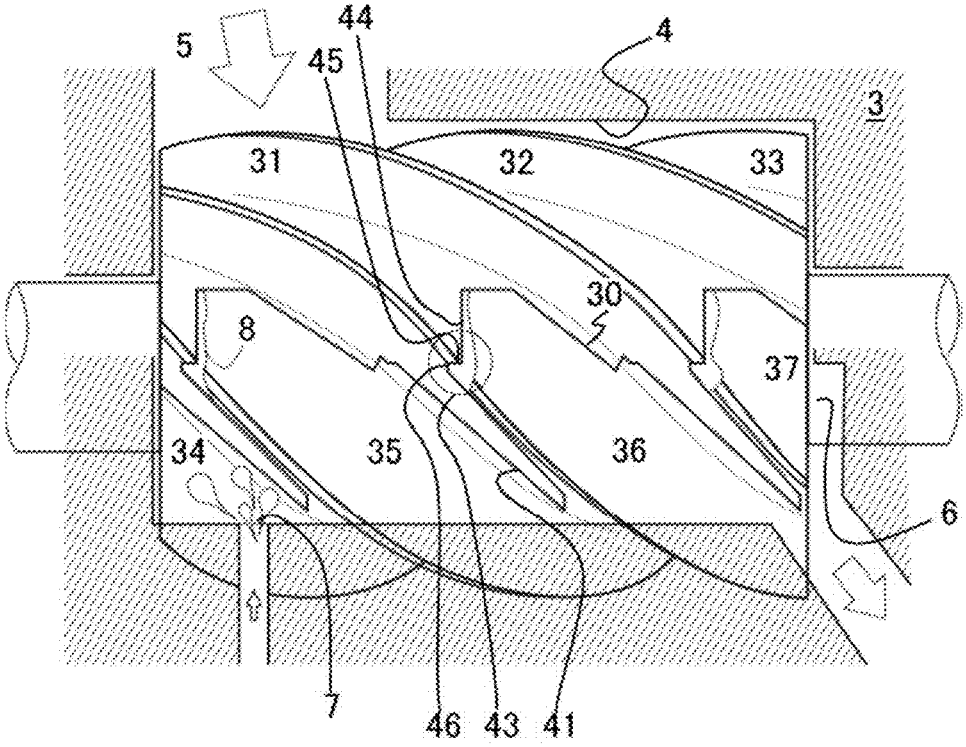
FIG. 3 is a transparent side view illustrating a seal line and an operation chamber formed between the rotors according to this embodiment.

When the male rotor 1 and the female rotor 2, which are three-dimensional bodies, are meshed with both the conventional tooth profile and the tooth profile of the present embodiment, both rotors are brought into contact with one continuous line. This line is called a seal line and is three-dimensionally bent and has the role of partitioning the operation chamber which can be located on the upper side of the rotor and the operation chamber which can be located on the lower side. Although the seal line is formed between both rotors, it cannot be visually observed, but as seen from the right side of FIG. 2, a permeable side view schematically illustrating the female rotor through the male rotor on the near side is illustrated in FIG. 3. A seal line 30 is drawn on the surface of the male rotor 1. Further, the cross-section of the casing 3 seen in FIG. 3 is not a single plane, but a plurality of cross-sections are illustrated jointly for convenience so that the principle and features of the present invention can be easily understood.

In each of the operation chambers 31 to 37 of the screw compressor, one tooth groove of each of both female and male rotors communicates with each other, and the outer circumference and the end surface thereof are formed by being closed with the bore 4 which is the inner surface of the casing. When the rotor is rotated, the operation chamber moves parallel to the axial direction from the suction side end to the discharge side end. Due to the parallel movement, since the internal volume of the operation chamber gradually decreases, the internal gas to be compressed is compressed. When pressure rises to a predetermined pressure, it communicates with the discharge port 6 which is a penetration hole opened at the bore end on the discharge side, and the gas to be compressed and the oil are discharged to outside of the bore. When the rear end of the operation chamber reaches the discharge end, the internal volume becomes 0, and the discharging is completed. The shape near the rear end of the operation chamber is determined by the tooth profile of the rotor. In the operation chamber of the rotor according to the present embodiment, the upper half region is eliminated first, and the lower half region remains to the last.

The shape of the seal line 30 is determined by the tooth profile, but the feature of the seal line according to this embodiment is the shape of the rear end of the operation chamber. The seal line 30 is bent, a portion 41 extending under the seal line extending long downward in the right direction is a boundary, and divides the left and right operation chambers (for example, the operation chambers 35 and 36). That is, the portion 41 extending under the seal line has a shape in which the lower half region extends toward the suction side with respect to the upper half region when the contour of the operation chamber is viewed from the rotor side surface. At the rear end (the left end in FIG. 3) of each of the divided operation chambers, a step 43 of a seal line is formed as surrounded by a circle. The step 43 is due to the tooth profile of the present invention.

The right side of the step is a position at which the front tooth tip point 12 and the front tooth base point 22 are in contact with each other, and at that time, a certain range of the advancing surface simultaneously comes into contact with each other. Therefore, in FIG. 3, the seal line vertically extending above the contact point becomes vertical portion 44. As the meshing progresses from this point, one point on the tooth tip circular arc of the male rotor and one point on the tooth base circular arc of the female rotor continue to come into contact with each other, but the seal line forming the step in FIG. 3 becomes a horizontal portion 45. Since the teeth of the rotor are twisted, the cross-sectional shape generated by the rotor rotation in the same cross-section perpendicular to the axis is reproduced in the cross-section which is moved leftward in the axial direction. As the rotation further progresses, or when looking at the cross section on the left side in FIG. 3, the rear tooth tip point 11 and the rear tooth base point 21 are in contact positions. At this time, the female and male rotors are in contact with each other at the same time in the range of the retreating surface side, and in FIG. 3, a vertical line 46 at the rear end of the operation chamber is formed.

Since the internal volume gradually expands in the operation chambers 31 to 33 in which the upper side of the seal line 30 is in the suction process, the gas to be compressed flowing in from the suction port 5 opened in the casing 3 is suctioned therein. The operation chambers 34 to 37 in the compression process and the discharging process are arranged on the lower side of the seal line 30. The volumes of these operation chambers are gradually reduced.

The operation chamber is a space in which the teeth grooves of both rotors (because the male rotor is the space formed between the teeth and the adjacent teeth, and the female rotor is a concave tooth, it is a space surrounded by the teeth) communicates one by one with each other to form a V shape. The outer side of the operation chamber is closed by the inner surface and the end surface of the bore 4 of the casing 3, and since the space between the rotors 1 and 2 is blocked by the seal line 30, a closed space is formed. As mentioned above, since a minute gap for smoothly rotating the rotor is present between both rotors or between the rotor and the bore, there is a slight internal leakage of gas to be compressed or oil, but it is not directly related to the essence of this embodiment.

When both rotors 1 and 2 are rotated while being meshed with each other, the operation chambers 31 to 37 move to the right side from the suction side end to the discharge side end like the rotary advertisement tower of the barbershop. In FIG. 3, the operation chamber 34 just after the start of compression completes the suction and becomes a closed space deviated in position from the contour of the suction port 5, and the compression is started. Oil is injected from the oil injection port 7 to here. The operation chamber 35 in the compression process has an internal volume smaller than that of the operation chamber 34 and is at a position at which the internal pressure increases. The operation chamber 36 just after the start of discharge further rises in internal pressure, communicates with the discharge port 6, and starts to discharge the gas to be compressed. Discharging of the operation chamber 37 in the discharging process proceeds, and discharges the gas to be compressed and oil in which compression is completed from the discharge port 6.

Although it is the oil injected into the operation chamber 34, since the oil has a density of much higher than the gas to be compressed and is injected at a speed slower than the movement speed of the operation chamber, the oil tends to accumulate at the rear end of the operation chamber. Therefore, the oil moves so as to be scraped by the rotor at the rear end of each operation chamber. Even in the discharging process, even if the operation chamber moving relative to the discharge port 6 opens, the rate at which the gas to be compressed is discharged is high at the initial stage, and most of the oil is discharged at the last stage.

Figure 4:
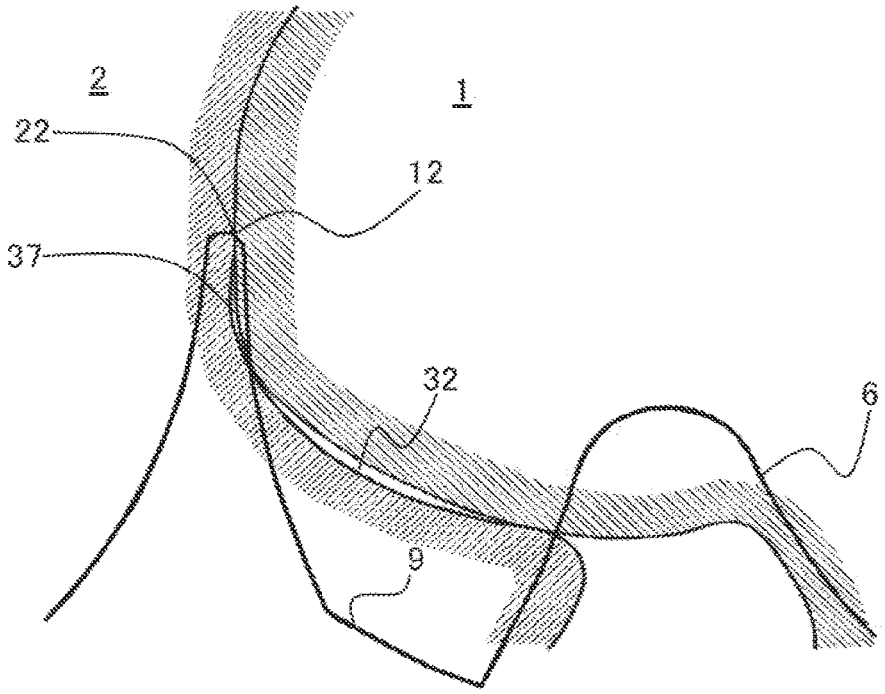
FIG. 4 is a discharge end view illustrating the operation chamber just before completion of discharge according to this embodiment.

Since the opening area of the discharge port decreases at the final stage of the discharging process, troubles of increasing discharge resistance tend to occur. This will be described in detail with reference to FIG. 4. FIG. 4 is an enlarged view of the vicinity of the discharge end of FIG. 3 and is drawn as seen from the right side of FIG. 3. Although there is a bore end surface of the casing which is originally located on the front side and covers the rotor end surface, it is perspectively illustrated, but the contour line of the discharge port 6 which is the opening portion of the bore end surface is illustrated. Therefore, the inner side of the contour line is a hole communicating with the outside of the casing 3, but other parts can be considered to block the rotor end surface with a slight gap between them.

The contour line of the discharge port 6 illustrated in FIGS. 1 and 4 does not protrude upward in the rotational direction from the line segment connecting the rotation centers 13 and 23 of both rotors, and is formed only in the lower half region. This is to prevent the compressed high-pressure gas from flowing backward to the suction side when opening, since the end surface of the operation chamber in the suction process passes through the region above the line segment. For the same reason, a tongue-shaped projection portion 9 which protrudes like a tongue in a region below the line segment also exists to block the end surface of the operation chamber 32 in the suction process.

Figure 5:
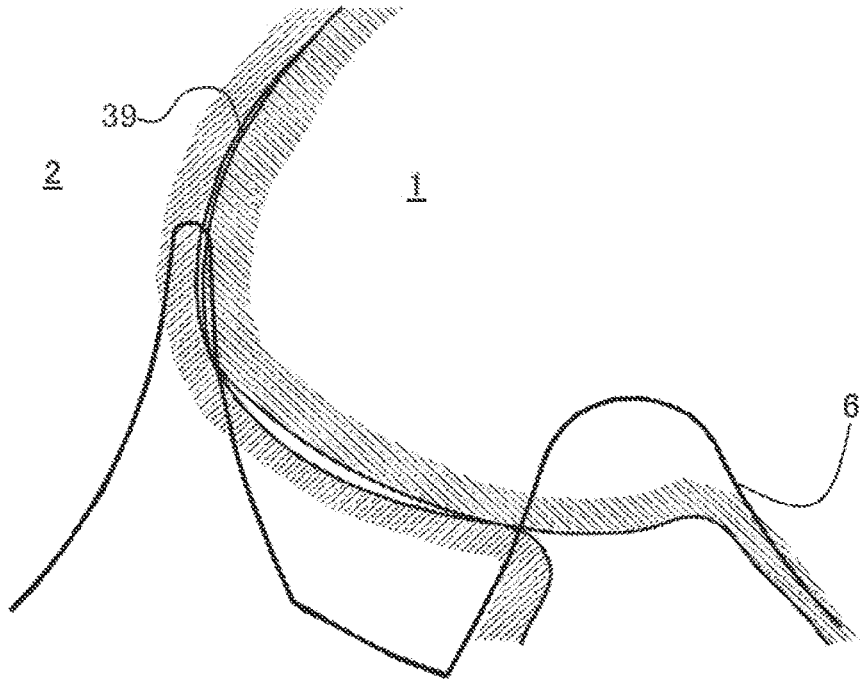
PRIOR ART FIG. 5
FIG. 5 is a discharge end view illustrating the operation chamber just before the completion of discharge according to Patent Document 1.

In addition, for comparison, FIG. 5 illustrates the same parts as in FIG. 4 of the screw compressor according to Patent Document 1.

Further, FIG. 6 is a cross-sectional view schematically illustrating the state of the operation chamber moving with time and the discharge of gas to be compressed and oil accompanied therewith.

Figure 6A:
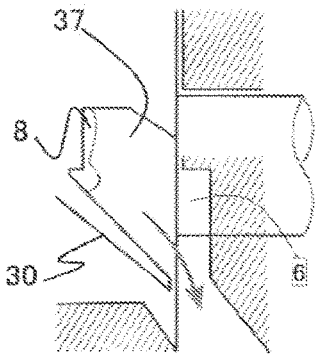
FIGS. 6A to 6C are schematic cross-sectional views of the operation chamber moving with time according to this embodiment.
Figure 6B:
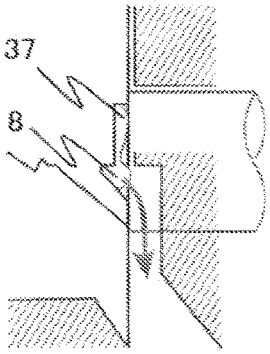

The final stage of the discharging process will be described with time with reference to FIG. 6. In general, in an oil-cooled screw compressor, an operation chamber in which the gas to be compressed and oil are mixed and confined is formed in the compressor. Compression is performed by reducing the volume of the operation chamber, a predetermined pressure increase is completed, the discharge port is opened, and the gas to be compressed and oil are discharged. Although the volume reduction of the operation chamber continues to be 0 and disappears, the opening area of the discharge port also gradually decreases. As illustrated in FIG. 6A, the operation chamber 37 in the discharging process decreases in internal volume, while moving in the right direction, and the gas to be compressed continues to be discharged from the discharge port. At this time, since the oil 8 injected into the operation chamber has a higher density than the gas to be compressed, it tends to accumulate at the rear end in the moving operation chamber. In the state FIG. 6B in which the discharge progresses, almost only the oil 8 is inside the operation chamber 37 in the discharging process. Although the viscosity of the oil 8 is larger than the viscosity of the gas to be compressed, the opening area of the discharge port 6 is sufficiently secured. Although the upper half of the operation chamber is not opened directly to the discharge port, it flows downward and is discharged with almost no obstruction. The reason thereof is that the size in the backward direction of the upper half is small, which is very small in terms of volume. Furthermore, in the state of FIG. 6C, the entire region of the operation chamber faces the discharge port 6 and is discharged without any obstruction. That is, in this embodiment, since the upper half region of the operation chamber disappears first and only the oil accumulated in the lower half region is discharged, the discharge resistance can be reduced.

Figure 6C:
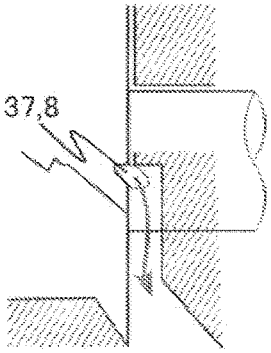

FIG. 4 is a view of the state of FIG. 6C as viewed from the end surface direction. Although the operation chamber 37 in the discharging process has a very thin crescent shape, it is clear that the entire region is inside the contour line of the discharge port 6 and does not hinder the discharge. Thereafter, since the operation chamber 37 in the discharging process remains inside the contour line of the discharge port 6 until it disappears, the oil is smoothly discharged to the last one.

Figure 7A:
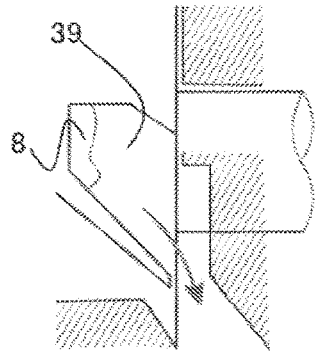
PRIOR ART Fig. 7A
FIGS. 7A to 7C are schematic cross-sectional views of the operation chamber moving with time according to Patent Document 1.
Figure 7B:
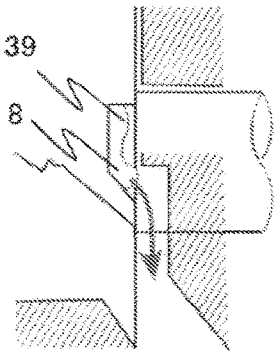

For comparison, the final stage of the same discharge in the conventional example will be described with reference to FIG. 7. The state of FIG. 7A is the same in that the oil 8 tends to accumulate at the rear end of the operation chamber 39 in the discharging process. However, the shape of the rear end is different, and the rearmost end comes out above the plane including the center line of the female and male rotors 1 and 2. For this reason, when the discharge advances to the state FIG. 7B, a certain amount of oil still remains in the upper part and since the discharge port 6 is only in the lower half, the opening area with respect to the amount of oil to be discharged is small. Thus, the discharge resistance increases, and the pressure of the oil suddenly rises. Furthermore, when a state of FIG. 7C is obtained, its influence further expands.

Figure 7C:
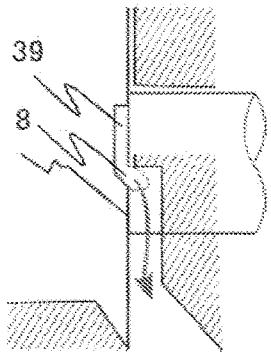

FIG. 5 is a view of the state of FIG. 7C as viewed from the end surface direction of the rotor. Since the operation chamber 39 in the discharging process has a crescent shape which has a narrow width but is long in the vertical direction, the amount of oil remaining in the operation chamber 39 is also larger than in the case of FIG. 4. Nevertheless, since the portion opening to the discharge port 6 is only the lower portion of the operation chamber 39 in the discharging process, the discharge resistance is large. That is, in the conventional operation chamber, since the operation chamber disappears simultaneously on the upper and lower sides, the oil in the upper half was once discharged through the discharge port after moving downward.

In this way, in the conventional tooth profile, despite the fact that the discharge resistance is larger than this embodiment, since the operation chamber surely reduces the volume, the pressure of the inside oil inevitably rises sharply. The pressure acts on the rotor tooth surface and leads to an increase in torque for driving the rotor. Although the area in which the oil pressure acts is small, the energy loss exceeds the measurement error or negligible level due to the high pressure.

In contrast, according to this embodiment, the operation chamber just before disappearance exists only in the lower half region from the line connecting the centers of the female and male teeth shapes, and the opening area with respect to the operation chamber volume increases. This makes it possible to smoothly discharge the oil and to prevent a sudden rise in the internal pressure of the operation chamber just before disappearance. Therefore, since the torque for driving the rotor can be reduced, and the power consumption of the motor that gives rotation and the fuel consumption of the engine can be reduced, it is possible to achieve an oil-cooled screw compressor with high energy efficiency and excellent energy saving.

Incidentally, in the shape of the contour line, the range not defined herein is not concerned with "smooth discharge of oil just before the disappearance of the operation chamber" which is the essence of the present invention.

Although the embodiments have been described above, the present invention is not limited to the embodiments described above, but includes various modifications. For example, the above-described embodiments have been described in detail in order to describe the present invention in an easy-to-understand manner, and are not necessarily limited to those having all the configurations described.

REFERENCE SIGNS LIST

1 Male rotor
2 Female rotor
3 Casing
4 Bore
5 Suction port
6 Discharge port
7 Oil injection port
8 Oil
9 Tongue-shaped projection portion
11 Rear tooth tip point of male rotor
12 Front tooth tip point of male rotor
13 Rotation center of male rotor
21 Rear tooth base point of female rotor
22 Front tooth base point of female rotor
23 Rotation center of female rotor
30 Seal line
31 to 37 Operation chamber
39 Operation chamber in discharging process of conventional example
41 Portion extending under seal line
43 Step of seal line
44 Vertical portion of seal line
45 Horizontal portion of seal line
46 Vertical line of rear end of operation chamber
47 Tooth base circle
48 Tooth tip circle
49 Female pitch circle
50 Male pitch circle

The invention claimed is:

1. An oil-cooled screw compressor comprising:

a pair of a male rotor and a female rotor that mesh with each other around parallel two axes and each have twisted teeth, wherein a tooth profile of the female rotor has a circular arc section that coincides with an inscribed circle of the female rotor, a tooth profile of the male rotor has a circular arc section coincident with a circumscribed circle of the male rotor, and a ratio of a central angle of the circular arc section of the male rotor to a central angle of the circular arc section of the female rotor is a ratio of a number of teeth of the male rotor to the number of teeth of the female rotor.

2. The oil-cooled screw compressor according to claim 1, wherein a contour line of a discharge port provided in a casing configured to house the male rotor and the female rotor passes through a base point which is a position through which a tooth tip of the male rotor passes on a line segment connecting axes of the male rotor and the female rotor, and a contour line extending from the base point to a male rotor side is located on a locus line when the tooth tip of the male rotor facing the base point is reversely rotated or to be closer to a center of the tooth profile of the male rotor than the locus line, and a contour line extending from the base point to a female rotor side is located on a locus line when a tooth base of the female rotor is reversely rotated or to be closer to a center of the tooth profile of the female rotor than the locus line.

3. The oil-cooled screw compressor according to claim 1, wherein a contour line of a discharge port provided in the casing configured to house the male rotor and the female rotor does not exceed a line segment connecting rotation centers of the male rotor and the female rotor.

4. The compressor according to claim 3, wherein tooth grooves of the male rotor and the female rotor are configured such that an operation chamber of an upper half region in the rotation direction from a line segment connecting the rotation centers of the male rotor and the female rotor disappears earlier and an operation chamber of a lower half region remains, with rotation of the male rotor and the female rotor.

5. The oil-cooled screw compressor according to claim 1, wherein tooth grooves of the male rotor and the female rotor are configured such that an operation chamber of an upper half region in a rotation direction from a line segment connecting the rotation centers of the male rotor and the female rotor disappears earlier and an operation chamber of a lower half region remains, with rotation of the male rotor and the female rotor.

6. The oil-cooled screw compressor according to claim 1, further comprising:

a casing which has a bore including two cylindrical holes that partly overlap and have the same length to accommodate the pair of the male rotor and female rotor, and in which an end surface of the bore is a bore end surface that faces in parallel with end surfaces of the pair of the male rotor and female rotor at a slight gap, the casing being provided with an oil injection port that communicates with at least one of operation chambers formed by being surrounded with tooth grooves of the pair of the male rotor and female rotor meshing with each other and the bore accommodating the tooth grooves, and the bore end surface being provided with an opening portion serving as a discharge port configured to discharge oil injected together with a gas to be compressed.

7. The oil-cooled screw compressor according to claim 1, wherein most of teeth of the male rotor are located outside a male pitch circle centered on an axis of the male rotor in a cross section perpendicular to the axis of the male rotor, and most of teeth of the female rotor are located inside a female pitch circle centered on the axis of the female rotor in the cross section perpendicular to the axis of the female rotor.

8. An oil-cooled screw compressor comprising:

a pair of a male rotor and a female rotor that mesh with each other around parallel two axes and each have twisted teeth, wherein a tooth profile of the female rotor has a circular arc section that coincides with an inscribed circle of the female rotor, a contour line of a discharge port provided in a casing configured to house the male rotor and the female rotor passes through a base point which is a position through which a tooth tip of the male rotor passes on a line segment connecting two axes of the male rotor and the female rotor, and a contour line extending from the base point to a male rotor side is located on a locus line when the tooth tip of the male rotor facing the base point is reversely rotated or to be closer to a center of a tooth profile of the male rotor than the locus line, and a contour line extending from the base point to a female rotor side is located on a locus line when a tooth base of the female rotor is reversely rotated or to be closer to a center of the tooth profile of the female rotor than the locus line.

9. The oil-cooled screw compressor according to claim 8, wherein the tooth profile of the male rotor has a circular arc section coincident with a circumscribed circle of the male rotor, and a ratio of a central angle of the circular arc section of the male rotor to a central angle of the circular arc section of the female rotor is a ratio of a number of teeth of the male rotor to the number of teeth of the female rotor.

10. The oil-cooled screw compressor according to claim 8, wherein the contour line of the discharge port provided in the casing configured to house the male rotor and the female rotor does not exceed a line segment connecting rotation centers of the male rotor and the female rotor.

11. The compressor according to claim 10, wherein tooth grooves of the male rotor and the female rotor are configured such that an operation chamber of an upper half region in the rotation direction from a line segment connecting the rotation centers of the male rotor and the female rotor disappears earlier and an operation chamber of a lower half region remains, with rotation of the male rotor and the female rotor.

12. The oil-cooled screw compressor according to claim 8, wherein tooth grooves of the male rotor and the female rotor are configured such that an operation chamber of an upper half region in a rotation direction from a line segment connecting the rotation centers of the male rotor and the female rotor disappears earlier and an operation chamber of a lower half region remains, with rotation of the male rotor and the female rotor.

13. The oil-cooled screw compressor according to claim 8, further comprising:

the casing has a bore including two cylindrical holes that partly overlap and have the same length to accommodate the pair of the male rotor and female rotor, and in which an end surface of the bore is a bore end surface that faces in parallel with end surfaces of the pair of the male rotor and female rotor at a slight gap, the casing being provided with an oil injection port that communicates with at least one of operation chambers formed by being surrounded with tooth grooves of the pair of the male rotor and female rotor meshing with each other and the bore accommodating the tooth grooves, and the bore end surface being provided with an opening portion serving as a discharge port configured to discharge oil injected together with a gas to be compressed.

14. The oil-cooled screw compressor according to claim 8, wherein most of teeth of the male rotor are located outside a male pitch circle centered on an axis of the male rotor in a cross section perpendicular to the axis of the male rotor, and most of teeth of the female rotor are located inside a female pitch circle centered on the axis of the female rotor in the cross section perpendicular to the axis of the female rotor.

* * * * *